United States Patent [19]

Grandlouis

[11] Patent Number: 4,572,560

[45] Date of Patent: Feb. 25, 1986

[54] ASH REMOVER

[76] Inventor: James Grandlouis, 1072 St. Jovite Ridge, Orleans, Ontario, Canada, K1C 1Y7

[21] Appl. No.: 702,247

[22] Filed: Feb. 15, 1985

[30] Foreign Application Priority Data

Feb. 27, 1984 [CA] Canada ..... 448320

[51] Int. Cl.[4] ..... A47F 13/08

[52] U.S. Cl. ..... 294/55; 294/9

[58] Field of Search ..... 294/55, 9, 10, 50.9, 294/53.5, 49, 50.8; 15/257.1, 257.2, 257.5, 257.6; 220/2, 264

[56] References Cited

U.S. PATENT DOCUMENTS 4,361,245 11/1982 Allen et al. ..... 294/55

4,457,548 7/1984 Robins et al. ..... 294/9

*Primary Examiner*—James B. Marbert

*Attorney, Agent, or Firm*—R. William Wray & Associates

[57] ABSTRACT

An ash remover having a cover movably secured to a main body. The cover of the ash remover is movable between an open and a closed position by means of a handle connected to the cover and protruding through the top of the main body remote from the cover.

9 Claims, 4 Drawing Figures

ASH REMOVER

This invention relates to ash removers. Ash removers are utilized to remove ash, soot, and other debris from fireplaces, stoves, and furnaces.

In recent years, wood burning stoves have become increasingly popular whilst fireplace use has increased considerably. One of the particular problems with these types of heating devices is the removal of the residue ash.

There are scoops for picking up ash from a fireplace and placing it in a carrying receptacle. Some of these scoops have a hinged flap on top to prevent ash blowing out whilst the receptacle is carried to a refuse container. One scoop has been proposed wherein a front cover is pivotally mounted on rivets and is held in a closed position by means of a rake device. The cover is opened by unlocking a part of the rake device and taking hold of the cover with one's hand. This is an obvious disadvantage and may result in the user getting dirty hands or burnt hands if the scoop is hot.

It is an object of the present invention to provide an ash remover which substantially reduces the above-mentioned disadvantage.

According to the present invention there is provided an ash remover comprising a main body for carrying ashes, a cover secured to said main body and movable between an open and a closed position, a handle having one end connected to said cover, the other end of said handle terminating in a grip portion, said grip portion protruding through said body and being movable between a first position and a second position to cause said cover to correspondingly move between said open and closed positions.

Embodiments of the present invention will now be described, by way of example, with reference to the accompanying drawings in which.

Figure 1:
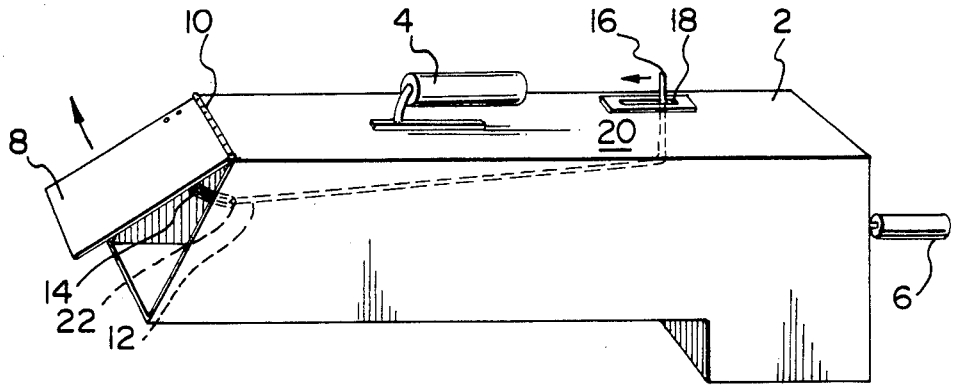
FIG. 1 is a perspective view of one embodiment of the invention.
Figure 2:
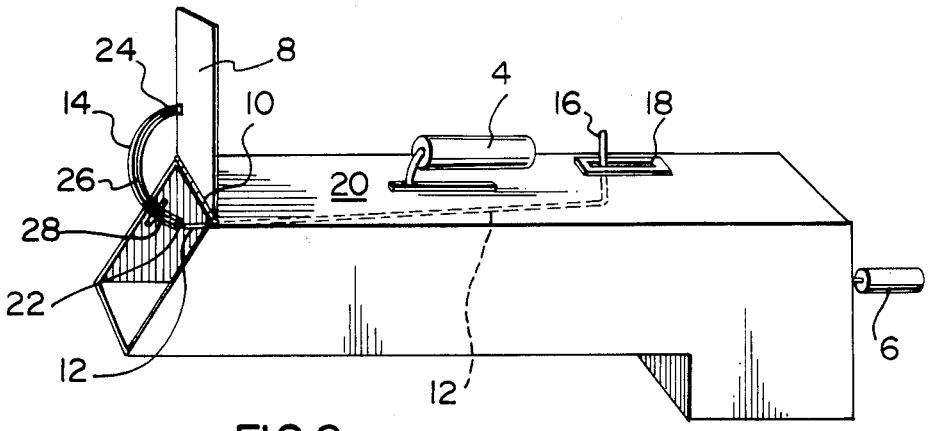
FIG. 2 is a perspective view of part of the embodiment of FIG. 1 in greater detail.

Referring to FIGS. 1 and 2, the ash remover has a main body 2 which is shaped as shown. The main body 2 is provided with handles 4 and 6 to facilitate carrying of the ash remover. A front cover 8 is hinged to the main body 2 of the ash remover by a piano hinge 10. Cover 8 measures approximately 11 cm in height and 21 cm in width. All remaining dimensions, unless otherwise noted, are proportionately based on these and are only exemplary.

The cover 8 is movable between an open and a closed position, by way of a rod-shaped handle 12 (see FIGS. 1 and 2). One end of the handle 12 is connected to the cover 8 by way of a half-moon-shaped slotted member 14 whilst the other end of handle 12 terminates in a grip portion 16. Grip portion 16, which may have a handle portion thereon for convenience in grasping it, protrudes through an elongate slot 18 in the top surface 20 of the main body 2 and the other end of handle 12 is connected at pillar 22 to one end of the slotted member 14. Slotted member 14 is curved and its other end is connected at pillar 24 (FIG. 2) to the cover 8. The slot

26 (FIG. 2) slidably engages with a guide pillar 28 which is rigidly mounted inside the main body 2 on one of the sides thereof. The guide pillar 28 facilitates controlled movement of the cover 8.

To use the ash remover to remove ash from a stove or fireplace, the cover 8 is opened by moving the grip portion 16 along said elongate slot 18 towards the front of the main body 2 to a first position (i.e. grip portion 16 is moved to the left in FIG. 1). This causes the cover 8 to pivot on the hinge 10 and to open. The ash remover is then approached towards the collection area for ashes in the stove or fireplace and the ashes are readily scooped through the uncovered opening due to the particular shape of the main body 2. If desired, a small brush, or other implement, can be used to ensure that all the ashes pass into the interior of the main body.

After all the ashes are within the main body 2, the cover 8 is closed by moving grip portion 16 to a second position in slot 18 towards the rear of the main body 2 (i.e. to the right in FIG. 1).

Figure 3:
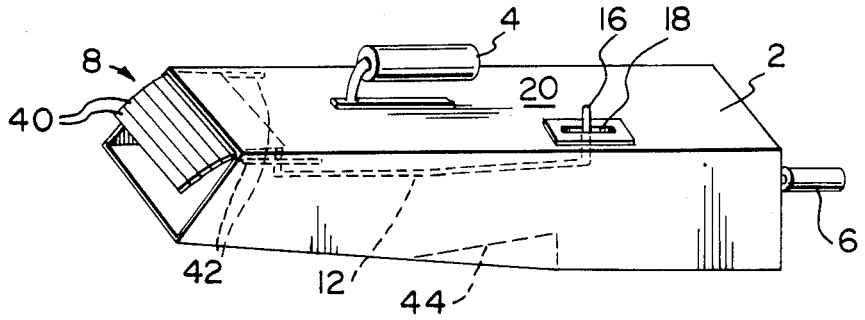
FIG. 3 is a perspective view of part of another embodiment of the invention.

In FIG. 3, an alternate embodiment is shown. For convenience, the same reference numerals are used in FIG. 3 as were used for corresponding parts in FIG. 1. The cover 8 is constructed of parallel segments 40 which are hingedly connected so as to be flexible whilst a supporting member 42 is provided on each inner side of the box whereby the cover can "roll" between its open and closed positions. Internally of the box, an ash holding insert 44 is provided to prevent loose ash from moving forward out of its storage position.

Handle 12 is attached to cover 8 in such a way that members 42 will not interfere therewith as the cover moves between its open and closed portions. As will be appreciated, if two supporting members 42 are provided they need only extend for a part of the way across the width of main body 2 and handle 12 can be attached to the middle portion of cover 8 without hindrance by members 42.

Movement of grip portion 16 will now be such that its first portion corresponding to opening of cover 8 will be towards the rear of the main body 2 whilst to close the cover 8 the grip portion 16 of handle 12 is moved along slot 18 towards the front of the main body 2. Movement of the grip portion 16 between its first and second positions causes cover 8 to "roll" between its open and closed positions due to the flexibility resulting from use of the slat segments 40 and the rigidity of handle 12. This can, of course, be constructed from a metal rod or in any appropriate manner. In its open position cover 8 is retracted within body 2 and is then substantially parallel to the top surface 20.

With the flexible, sectional door cover 8 of FIG. 3, the handle 12 may be extended to protrude beyond the rear of the main body 2 through an opening therein. Slot 18 would not then be provided. The handle 12 would then act as a push-pull rod and be attached to the top centre of the retractable door 8 to facilitate opening and closing thereof.

It will be seen that the described ash removers are particularly advantageous in that cover 8 can be conveniently moved between its open and closed position and the interior space of the main body is available for storing the collected ashes without hindrance from separate scoops or rake pans.

Figure 4:
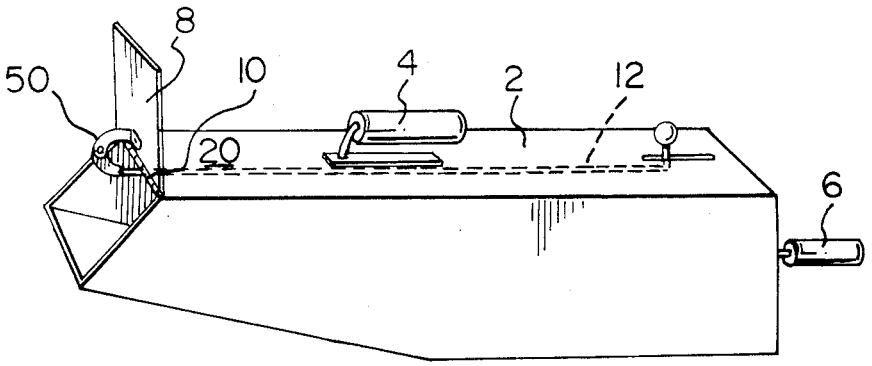
FIG. 4 is a perspective view of a second embodiment, the same reference numeral being applied to parts corresponding to parts in FIG. 1.

In FIG. 4 a second embodiment of the invention is shown wherein a double pivot portion 50 is utilized and corresponding modifications to handle portion 12 are provided.

It will be readily apparent to a person skilled in the art that a number of variations and modifications can be made without departing from the true spirit of the invention which will now be pointed out in the appended claims.

I claim:

1. An ash remover comprising:

(a) a main body for carrying ashes, (b) a cover secured to said main body and movable between an open and a closed position;

(c) a handle having one end connected to said cover, (d) the other end of said handle terminating in a grip portion, (e) said grip portion protruding through said body and being movable between a first position and a second position to cause said cover to correspondingly move between said open and closed positions, (f) wherein said handle is a rod-shaped member attached at one end remote from said grip portion to one end of a curved slotted member, the other end of the slotted member being attached to said cover, a guide member on said main body, in use the slot in said slotted member cooperating with said guide member to facilitate controlled movement of the cover, said curved member being a substantially arcuate member with the crown thereof towards the inside of the main body such that when said cover is in said open position said other end of the slotted member is substantially above said main body whereby the edge of said cover remote from its connection to said main body is also substantially above said body so as to provide a clear entrance to said main body to thereby facilitate the scooping of ash.

2. An ash remover according to claim 1 wherein said cover is secured to said main body by a piano hinge.

3. An ash remover according to claim 1, wherein said grip portion is a part of said handle protruding through said body.

4. An ash remover according to claim 1, including a first carrying handle on the rear of the ash remover and a second carrying handle on the top of the ash remover.

5. An ash remover according to claim 1 wherein said handle is attached at one end remote from said grip portion to one end of a double pivot portion, the other end of the double pivot portion being attached to said cover, in use the double pivot portion facilitating controlled movement of the cover.

6. An ash remover comprising:

(a) a main body for carrying ashes, (b) a cover secured to said main body and movable between an open and a closed position, (c) a handle having one end connected to said cover, (d) the other end of said handle terminating in a grip portion, (e) said grip portion protruding through said body and being movable between a first position and a second position to cause said cover to correspondingly move between said open and closed positions, and (f) wherein said cover is constructed of a plurality of parallel segements, each parallel segment being hingedly connected to each adjacent parallel segment along its respective longitudinal edge to facilitate relative movement, one or more supporting members being provided on said main body whereby when said grip portion is in said first position the cover is retracted within said main body.

7. An ash remover according to claim 6 wherein said handle is a rod-shaped member attached at one end remote from said grip portion to said cover.

8. An ash remover according to claim 7 wherein said grip portion is a part of said handle protruding through said body.

9. An ash remover according to claim 6, including a first carrying handle on the rear of the ash remover and a second carrying handle on the top of the ash remover.

* * * * *